United States Patent [19]

Jackson, Jr.

[11] 4,002,163

[45] Jan. 11, 1977

[54] EXERCISER AND ROLLER MASSAGE DEVICE

[76] Inventor: Andrew Dudly Jackson, Jr., Raymondville, Port Mansfield Station, Tex. 78580

[22] Filed: Sept. 15, 1975

[21] Appl. No.: 613,117

[52] U.S. Cl. ..... 128/57

[51] Int. Cl.[2] ..... A61H 15/00

[58] Field of Search ..... 128/57, 24.3, 67; 272/57 R

[56] References Cited

UNITED STATES PATENTS

| | | | |
|---|---|---|---|
| 2,286,324 | 6/1942 | Wentz | 128/57 |
| 2,461,413 | 2/1949 | Dirand | 128/57 |
| 3,637,205 | 1/1972 | Bankston | 128/57 |
| 3,858,579 | 1/1975 | Ching | 128/57 |

*Primary Examiner*—Lawrence W. Trapp
*Attorney, Agent, or Firm*—Murray Robinson

[57] ABSTRACT

A combined active and passive exerciser to facilitate both body movement and massage effected by the user's own muscles comprises a core with three sleeves rotatably disposed end to end and retained thereon by cup shaped end locks or ferrules at the ends of the core, and having rubber cups slipped over the end locks to provide antiskid pivots. The end sleeves provide handles and the center sleeve, which is covered with a soft material, provides a roller. A variety of body movements and massage actions can be performed with the exerciser.

7 Claims, 2 Drawing Figures

EXERCISER AND ROLLER MASSAGE DEVICE

BACKGROUND OF THE INVENTION

This invention pertains to exercisers and more particularly to a device serving both to facilitate certain body movements employing active use of the body muscles and to facilitate body massage effecting passive distortion of the body muscles and other soft tissues.

Exercise devices may be divided into two categories, active exercisers wherein the one getting the exercise employs his own muscles in moving the exerciser device and passive exercisers wherein another person or machine causes motions of the body of the one getting the exercise. Active exercisers known to the prior art include, for example, Indian clubs, bar bells, single and multiple elastic cables with and without special hand grips. Passive exercisers include such devices as power driven rollers and vibrating belts.

The present invention is a combination active and passive exerciser. Among its advantages are its low cost, compactness, light weight, simplicity, and portability, while facilitating significant physical exercise. It is also useful in connection with gymnastic art forms akin to the limbo, e.g., the hereinafter described May pole exercise.

SUMMARY OF THE INVENTION

According to the invention there is provided an exerciser comprising a stout slender cylindrical core, e.g., 40 inches long by 1¼ inches in diameter, preferably made of wood, three sleeves disposed end to end and snugly but rotatably mounted on the core, the sleeves typically having a wall thickness of ⅛ inch and preferably being made of plastic or aluminum, the end sleeves providing handles and the center sleeve providing a roller, the roller preferably being covered with a soft material such as vinyl suitable for direct contact with the body during massage, the sleeves being retained on the core by end locks, and end caps having exterior anti-skid surfaces and providing pivots, the end locks preferably taking the form of plastic ferrules which may be glued or pinned to the core, the end caps being made of rubber a little softer than an auto tire, about like a crutch ferrule, frictionally engaged with the end locks.

BRIEF DESCRIPTION OF THE DRAWINGS

For a detailed description of a preferred embodiment of the invention, reference will now be made to the accompanying drawings wherein.

DESCRIPTION OF PREFERRED EMBODIMENT

Figure 1:
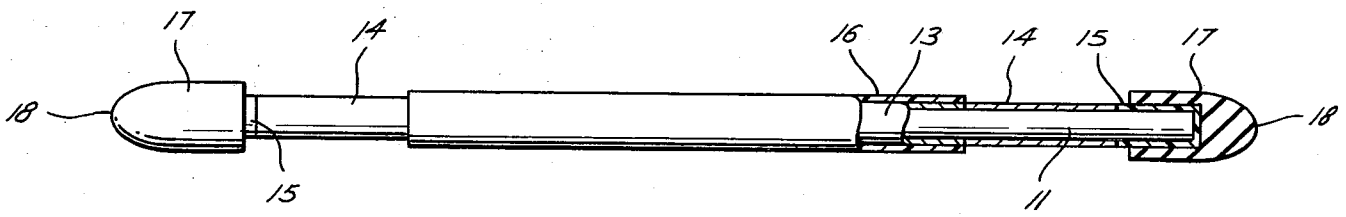
FIG. 1 is a side elevation partly in section, of an exerciser embodying the invention.
Figure 2:
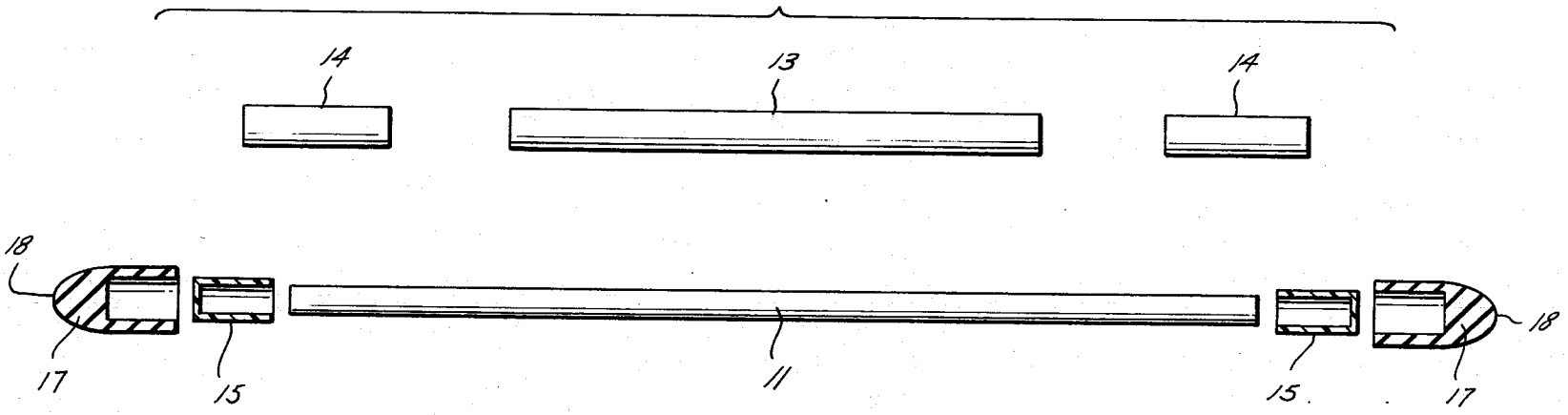
FIG. 2 is an exploded view of the exerciser shown in FIG. 1.

Referring now to FIGS. 1 and 2 there is shown an exerciser comprising a core 11, a center sleeve 13, two end sleeves 14, and two end locks 15. The center sleeve is provided with a covering 16. End caps 17 are fitted over the end locks.

The materials chosen for the exerciser are preferably light in weight, but if it is desired to employ the exerciser also as a resisting member such as dumbbells, heavy materials such as steel could be used. Whatever materials are used should be non-toxic and non-irritating to the skin, since the exerciser will often be in contact with various parts of the user's body.

Core

The core is a rod made of stout, stiff material, preferably wood or other light weight, strong material. A pine dowel rod 1 ¼ to 1 ⅜ inches in diameter and 40 inches long is suitable. Lengths of 36 inches to 42 inches would be the preferred range. The exterior of the wood should be smooth to allow easy rotation thereon of the sleeves next to be described.

Sleeves

The sleeves are rigid so as to turn on the core without binding, preferably being made of light weight metal, such as aluminum, or plastic, such as vinyl, which will turn freely on the core material.

The end sleeves, which provide hand grips or handles should be at least four and preferably six inches long. The center sleeve, which provides the roller, is preferably about 22 inches long, being the approximate width of a human body, i.e., in a range of 18 to 28 inches.

Typically the sleeves are ⅛ inch thick, snugly fitting around the core but freely rotatable thereon. The end sleeves provide handles or hand grips, so the outer circumference of the end sleeves should be somewhere in the range of about 2.4 inches (size of an umbrella handle) to 7.2 inches (size of an oar handle), or a diameter range of from ¾ inch to 2¼ inches. The thickness of the handle sleeve will depend on the core diameter and the desired outer diameter of the handles. The outer peripheries of the handles may have any suitable finish, e.g., as is known for hand grips, but preferably are smooth since they may incidentally come into contact with other parts of the body than the hands when the exerciser is used.

The center sleeve 13 which forms the base of the roller is preferably of the same inner diameter as the handles so that the core can be of uniform diameter. A stepped construction for the core might be more expensive and the stress increase at the diameter changes might unduly weaken the core unless made of extra strong material. The exterior of the roller is preferably covered with a soft compliant material such as soft vinyl, e.g., having a durometer hardness in the range of 40 to 90 on the Shore A scale which is the range of hardness of reclaimed rubber. The roller is intended to be placed in direct contact with the body so its covering should be smooth like the handles. The covering may be secured to the sleeve in any desired manner, such as by cement, or can be elastically retained in position by friction.

Locks

The end locks 15 are cup shaped members, preferably made of a stiff plastic such as PVC, glued with epoxy to the end of the core. The end locks prevent the sleeves from slipping off the core. Also, they strengthen the ends of the wood core, preventing it from crushing or splitting. The end locks could also be plain metal sleeves.

End Caps

The end caps 17 are cup shaped members made of rubber adapted to slip over the end locks and be elastically and frictionally retained thereon. The rubber preferably has the hardness of a crutch or cane ferrule tip, a little softer than an auto tire, e.g., having a Shore A durometer hardness in the range of 40–90 the same as the coating 16 of the center sleeve 13. The other surface of each end cap, is ovoid, i.e., approximately the shape of a paraboloid. This provides a blunt point 18, the end cap being intended to serve as a pivot during certain uses of the exerciser. The point 18 is desirable for definite location of the center of rotation. The bluntness of the point is desirable for strength and to prevent injury, but a definite point is desirable to provide a small area of contact and to prevent the pivot from moving sideways during use.

Exercises

As illustrative of the use of the exerciser, several particular exercise routines will be described. With reference to the passive or massage type exercise it will be remembered that one of the body's circulatory systems, the lymphatic, is dependent upon intermittent compression and release of the body tissues. This action compresses the lymphatic tubes and forces the fluid therein along the tubes in the direction permitted by their check valves. Such compression and relaxation is normally effected by body movement and muscle pressure, but it can also be created by external pressure this is part of the function of massage. The other function is that of surface irritation to which the body responds by dilation of the blood vessels causing increased blood supply. In any event massage has the effect of increasing the flow of body fluids, thereby invigorating the adjacent tissues.

Front Roll

One exercise routine performed while standing includes grasping of the handles with the user's hands and pressing the roller against the body, followed by moving the roller up and down over the front surface of the body, e.g. over the upper legs, the abdomen, and the upper torso. In addition to massaging the areas contacted by the roller, the exercise requires flexing and unflexing the arms during each up and down movement.

Back Roll

A similar exercise includes grasping the exerciser with the hands with the exerciser passing behind the user. With the roller pressed against the user, the exerciser is moved up and down to move the roller over the buttocks and lower back. As in the front roll the arms receive active exercise in flexing and unflexing as the exerciser is moved up and down.

The Step and Roll

A routine involving the legs actively as well as the arms includes starting out as in the front roll, moving the roller down past the abdomen, and then stepping over the exerciser one foot at a time, followed by an upward movement of the exerciser over the back as in the back roll. Then a downward movement over the back as in the back roll is followed by stepping backwards over the exerciser to move the exerciser to the front of the body. An upward motion of the exerciser as in the front roll returns one to the starting position from which the routine can be repeated.

The Brace

To square up the shoulders one picks up the exerciser with both hands, one on each handle, lifts it over his head, and lowers it as far as possible behind and in contact with the shoulders. Then the exerciser is elevated, passed over the head to the front of the body, the starting position, and the routine repeated.

Sit and Roll

Lying on the floor on one's back with the exerciser passing across the top of the legs, the user grasps each handle with one hand. From this position the user bends at the hips until the torso is vertical and then tilted forward. Meanwhile the arms are kept straight and the roller moves down past the knees toward the feet. From this position, hereinafter called the triangle position, the user can unbend, returning to the flat on the floor starting or supine position, the arms still being kept straight causing the roller to pass upwardly over the knees to the thighs. The routine is then repeated.

Kick and Roll

A more strenuous exercise starts from the supine position as in the sit and roll. When the triangle position is reached both legs are lifted and the knees brought up toward the chin sufficiently to allow the feet to be elevated and passed over the roller. The legs are then extended as far as possible to an extreme position. From the extreme position the motions are reversed passing through the triangle position to the supine position.

The May Pole

An acrobatic exercise starts from the supine position. Grasping one of the handles with both hands, or more precisely with one hand, the other hand grasping the one hand, the exerciser is placed over the head and the pivot at the opposite end brought into engagement with the floor. From this position one elevates the upper torso and then elevates the hips and arches the back. The feet are moved sideways gradually moving the body around the exerciser as a center.

The foregoing are illustrative of exercises that can be performed with the exerciser and to illustrate the functioning of its various components.

While a preferred embodiment of the invention has been shown and described, modifications of the invention can be made by one skilled in the art without departing from the spirit of the invention.

I claim:

1. An exerciser comprising a core and several sleeves rotatably mounted along the length of the core, the end sleeves being of a diameter and length to provide hand grips, a center sleeve being of a length comparable to the width of the human body to provide a body roller, and pivot means at the ends of the core, said sleeves being three in number and all of the same internal and external diameter disposed end to end along the core, and the center sleeve being provided with a covering of soft material.

2. Exerciser according to claim 1 in which the sleeves are retained on the core by end locks, each end lock comprising a ferrule cemented to an end of the core.

3. Exerciser according to claim 2, each pivot being cup shaped having a socket placed over one of the ferrules and frictionally retained thereon.

4. Exerciser according to claim 3, in which the core is made of wood, each ferrule is cup shaped and nested within the socket of the adjacent pivot, and the pivot is made of elastomeric material.

5. Exerciser according to claim 4 in which the exterior of the pivot has an ovoid shape, the pivot being made of rubber having a hardness in between that of hard and soft rubber.

6. An exerciser according to claim 5 in which the sleeves are rigid, being made of light weight material selected from the group consisting of light metals and plastics.

7. An exerciser according to claim 6 in which the sleeves are made of a vinyl plastic, the center sleeve being covered with a softer vinyl plastic.

* * * * *

UNITED STATES PATENT AND TRADEMARK OFFICE

CERTIFICATE OF CORRECTION

PATENT NO. : 4,002,163

DATED : January 11, 1977

INVENTOR(S) : Andrew Dudley Jackson, Jr.

It is certified that error appears in the above-identified patent and that said Letters Patent are hereby corrected as shown below:

Column 3, line 24, after the second occurrence of "pressure", insert -- ; --.

Signed and Sealed this

Twelfth Day of April 1977

[SEAL]

*Attest:*

RUTH C. MASON
*Attesting Officer*

C. MARSHALL DANN
*Commissioner of Patents and Trademarks*